US012171320B2

(12) United States Patent
De Bardonneche

(10) Patent No.: US 12,171,320 B2
(45) Date of Patent: Dec. 24, 2024

(54) TWO-PART WIPING DEVICE

(71) Applicant: SOCIETE INDUSTRIELLE DE MATIERES PLASTIQUES, ZAC du Plessis-Saucourt (FR)

(72) Inventor: Eric De Bardonneche, Montaren-et-Saint-Médiers (FR)

(73) Assignee: SOCIETE INDUSTRIELLE DE MATIERES PLASTIQUES, ZAC du Plessis-Saucourt (FR)

( * ) Notice: Subject to any disclaimer, the term of this patent is extended or adjusted under 35 U.S.C. 154(b) by 406 days.

(21) Appl. No.: 17/629,669

(22) PCT Filed: Jul. 31, 2019

(86) PCT No.: PCT/FR2019/051884

§ 371 (c)(1),
(2) Date: May 25, 2022

(87) PCT Pub. No.: WO2021/019131

PCT Pub. Date: Feb. 4, 2021

(65) Prior Publication Data

US 2022/0287435 A1 Sep. 15, 2022

(51) Int. Cl.
*A45D 34/04* (2006.01)
*A45D 40/26* (2006.01)

(52) U.S. Cl.
CPC ..... *A45D 34/046* (2013.01); *A45D 40/267* (2013.01)

(58) Field of Classification Search
CPC .. A45D 34/036; A45D 34/042; A45D 34/045; A45D 34/047; A45D 4/267; A45D 40/262; A45D 40/265; A45D 40/268
USPC ..... 401/121, 122, 126–130
See application file for complete search history.

(56) References Cited

U.S. PATENT DOCUMENTS

| | | | | |
|---|---|---|---|---|
| 3,861,810 | A | 1/1975 | Vasas | |
| 5,349,972 | A * | 9/1994 | Dirksing | A46B 9/021 401/122 |
| 5,597,254 | A | 1/1997 | Vasas | |
| 11,903,478 | B1 * | 2/2024 | Yan | A45D 34/046 |
| 2005/0175394 | A1 | 8/2005 | Gueret | |

FOREIGN PATENT DOCUMENTS

EP 1561394 8/2005

OTHER PUBLICATIONS

International Search Report & Written Opinion issued in Appl. No. PCT/FR2019/051884 (Apr. 3, 2020).

* cited by examiner

*Primary Examiner* — David J Walczak
(74) *Attorney, Agent, or Firm* — Barnes & Thornburg LLP; G. Peter Nichols

(57) ABSTRACT

A wiping device, for a device for packaging and applying a fluid or pasty product, which includes first and second independent parts, the first part having a hardness greater than or equal to a hardness of the second part, the first part having a male portion formed by a first skirt, the second part having a deformable wiping lip and a female portion formed by a second skirt and arranged so as to receive, by snap-fitting, the first skirt of the first part. The wiping device has locking means for locking the snap-fitting of the first skirt in the second skirt.

9 Claims, 3 Drawing Sheets

TWO-PART WIPING DEVICE

This application is a U.S. nationalization under 35 U.S.C. § 371 of International Application No. PCT/FR2019/051884, filed Jul. 31, 2019; the entire contents of which are incorporated herein by reference.

TECHNICAL FIELD OF THE INVENTION

The invention relates to a wiping device intended for a device for packaging and applying a liquid or pasty product, notably a mascara.

PRIOR ART

There are, currently, numerous wiping devices intended for devices for packaging and applying products like mascara. For example, the documents FR 3 005 835, FR 3 028 731 and FR 3 057 444 describe such wiping devices. These wiping devices comprise a first element comprising a deformable wiping lip and a second, more rigid element, which ensures that the wiping device is well held in a neck of a reservoir of the packaging and application device, the first and second elements being pre-assembled together before being put in place in the neck.

However, these known wiping devices have numerous drawbacks including an excessively random procedure for assembling the first and second elements, and assembly which requires dimensional tolerances exceeding the current standards for mass production. That result in a pre-assembly that is thus obtained after the abovementioned two elements have been fitted together which has a mediocre hold in the neck of the reservoir, not to mention the strength of the assembly which is sensitive to the transfer between the pre-assembly station and the station for placement in the reservoir neck: many pre-assemblies arrive there disassembled.

SUMMARY OF THE INVENTION

One aim of the invention is to provide a wiping device which does not have the above drawbacks, in particular a wiping device in two pre-assembled portions which supports transfer between two stations.

To that end, there is provided, according to the invention, a wiping device for a device for packaging and applying a fluid or pasty product, the wiping device comprising first and second independent parts, the first part having a hardness greater than or equal to a hardness of the second part, the first part comprising a male portion formed by a first skirt, the second part comprising a deformable wiping lip and a female portion formed by a second skirt and arranged so as to receive, by snap-fitting, the first skirt of the first part, the wiping device further comprising locking means for locking the snap-fitting of the first skirt in the second skirt.

Advantageously, but optionally, the wiping device according to the invention has to at least one of the following technical features:

- the locking means comprise a first bearing surface at right angles to a snap-fitting direction formed on the first skirt and a second bearing surface at right angles to a snap-fitting direction formed on the second skirt, the first and second surfaces coming to bear against one another upon a relative movement of the two parts in a direction opposite to the snap-fitting;

- the locking means comprise a first tapered surface formed on the first skirt adjacent to and downstream of the first bearing surface in the snap-fitting direction;
- the locking means comprise a second tapered surface formed on the second skirt adjacent to and downstream of the second bearing surface in the snap-fitting direction;
- the locking means are arranged on an outer wall of the first skirt and an inner wall of the second skirt;
- the second part comprises an end-of-travel abutment for the first part;
- the first part comprises a first clamping boss formed on an outer wall of the first part;
- the second part comprises a second clamping boss formed on an outer wall of the second skirt;
- the second clamping boss is positioned in line with the locking means;
- the second part comprises a third clamping boss formed on an outer wall of the second skirt;
- the second part comprises means for maintaining a geometry of the deformable wiping lip; and
- the means for maintaining a geometry comprise a second annular groove formed on an outer wall of the second part in line with the deformable wiping lip.

BRIEF DESCRIPTION OF THE FIGURES

Other features and advantages of the invention will become apparent on reading the following description of an embodiment of the invention. In the attached drawings.

For greater clarity, the elements that are identical or similar are identified by identical reference symbols throughout the figures.

DETAILED DESCRIPTION OF AN EMBODIMENT

Figure 3:
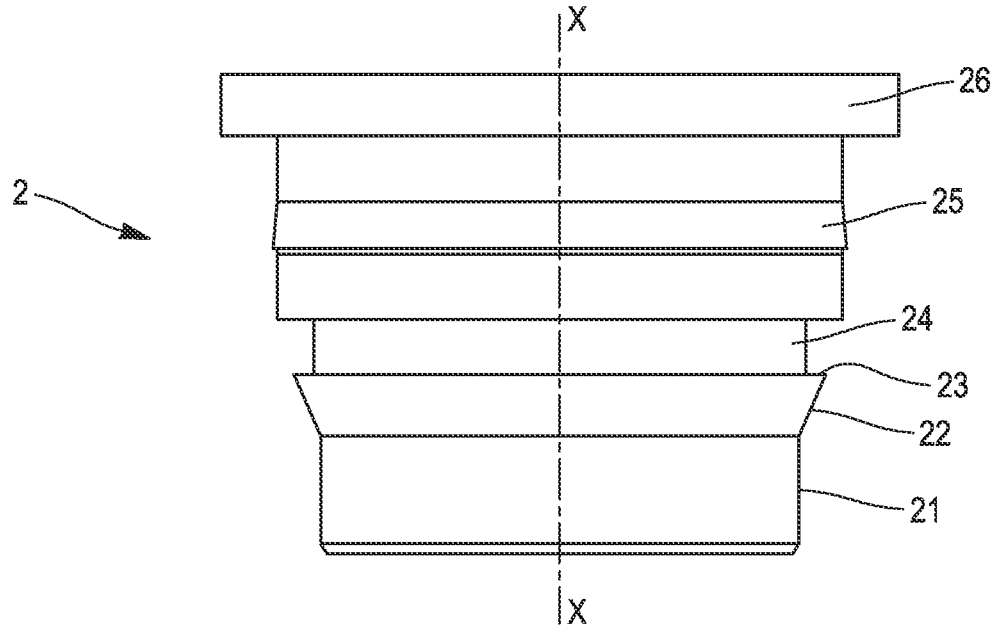
FIG. 3 is a side view of the first part of the wiping device according to the invention; and, FIG. 4 is a side view of the second part of the wiping device according to the invention.
Figure 4:
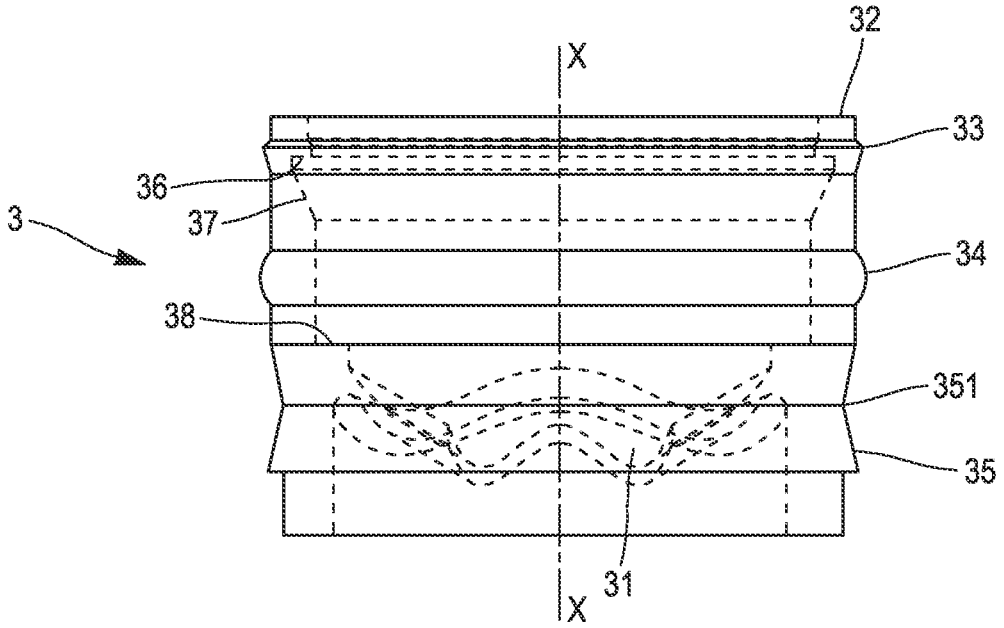

Referring to FIGS. 1, 3 and 4, there now follows a description of a wiping device 1 according to the invention. The wiping device 1 according to the invention comprises first 2 and second 3 independent parts intended to be assembled with one another to form the wiping device 1 according to the invention, here by snap-fitting of the first part 2 in the second part 3.

Figures 1A, 1B, 1C:
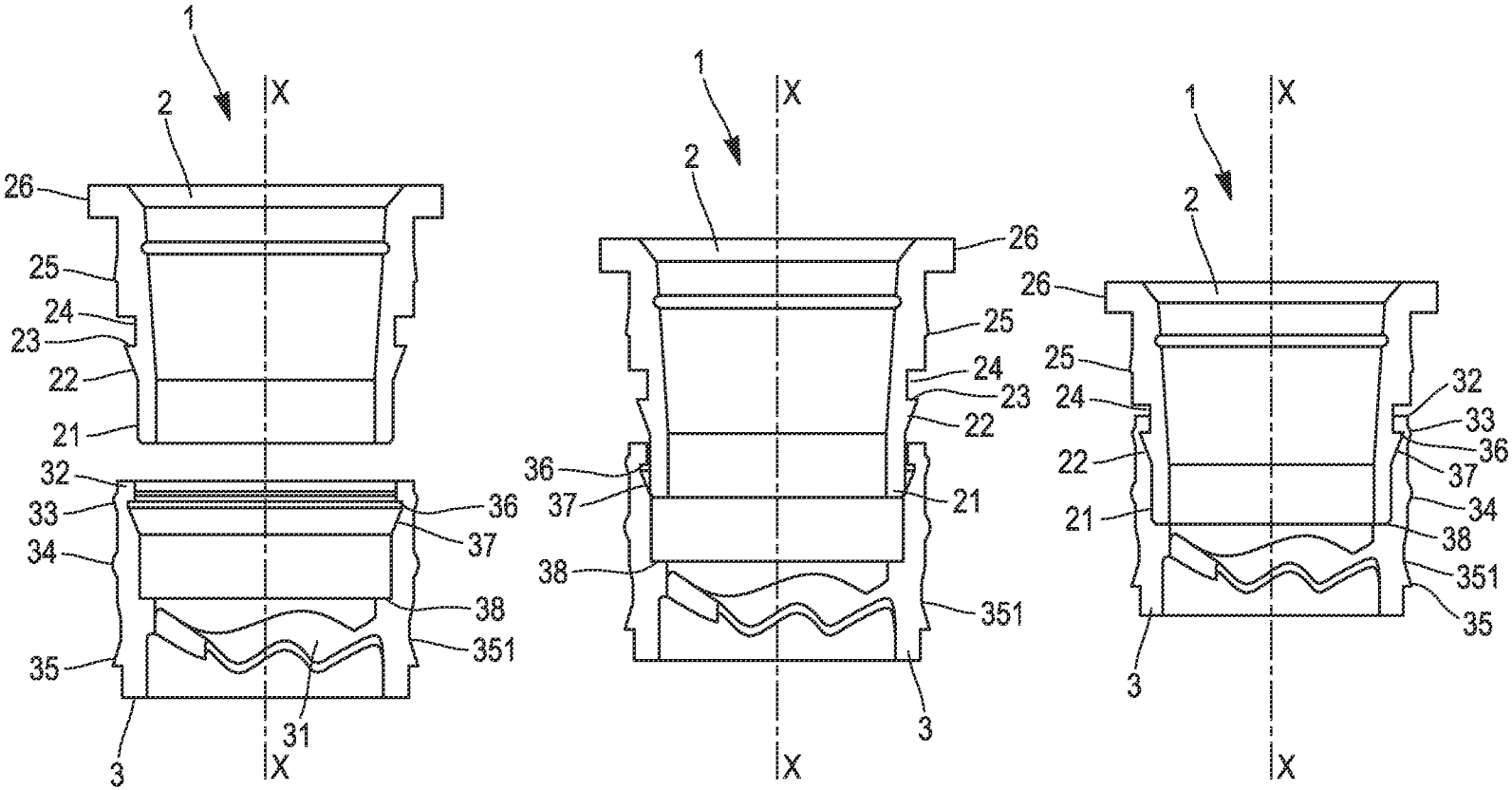
FIGS. 1*a*) to *c*) are cross-sectional views illustrating an embodiment of a two-part assembly of a wiping device according to the invention.

The first part 2 is of overall cylindrical form, here, of revolution of axis, a longitudinal axis XX of the first 2 and second 3 parts. The first part 2 comprises a top end 26 comprising a flange forming an abutment for placement in a reservoir neck of a device for packaging and applying a fluid or pasty product. Then, the first part 2 comprises an intermediate segment comprising, on a radially outer wall on which is formed a first clamping boss 25. Then, the first part 2 comprises a male portion formed by a first skirt 21 of cylindrical form. The first skirt 21 comprises, in the top portion, a first set 22, 23, 24 of locking means 22, 23, 24, 36, 37 for locking the snap-fitting of the first part 2 in the second part 3. This first set is formed on an outer wall of the first skirt 21 and comprises a first annular groove 24 delimited downward by a first bearing surface 23 extending at right angles to a direction of snap-fitting of the first part 2 in the second part 3. In this particular case, the direction of snap-fitting of the first part 2 in the second part 3 is parallel to the longitudinal axis XX of the first 2 and second 3 parts, the snap-fitting direction for producing the assembly of the first 2 and second 3 parts being from top to bottom in the figures, as illustrated by the series of FIGS. 1*a* to 1*c*. From the first bearing surface 23, the first set comprises a first tapered surface 22 which is continued by a cylindrical portion to a bottom end of the first skirt 21. The first tapered surface 22 is positioned adjacent to and downstream of the first bearing surface 23 in the direction of snap-fitting of the first part 2 in the second part 3.

The second part 3 is of overall cylindrical form, here, of revolution of axis, the longitudinal axis XX of the first 2 and second 3 parts. From top to bottom in FIG. 4, the second part 3 comprises a female portion formed by a single second skirt 32 of cylindrical form, here of revolution of longitudinal axis XX, then a bottom portion comprising a deformable, and therefore flexible, wiping lip 31.

The single second skirt 32 is overall of a form complementing a form of the first skirt 21 and is intended to receive, upon an assembly of the first 2 and second 3 parts, the first skirt 21 by sliding along the longitudinal axis XX. On a radially inner wall, the second skirt comprises a second set 36, 37 of the locking means 22, 23, 24, 36, 37 for locking the snap-fitting of the first part 2 in the second part 3. Here, the second set comprises a second bearing surface 36 extending at right angles to a direction of snap-fitting of the first part 2 in the second part 3. From the second bearing surface 36, the second set comprises a second tapered surface 37 which is continued by a cylindrical portion, forming part of the inner wall of the second skirt 32, to a bottom end of the second skirt 32 where an end-of-travel abutment 38 is formed. Thus, the second bearing surface 36 and the second tapered surface 37 form a tapered annular groove in the inner wall of the second skirt 32. The second tapered surface 37 is positioned adjacent to and downstream of the second bearing surface 36 in the direction of snap-fitting of the first part 2 in the second part 3. Under the end-of-travel abutment 38, there is the bottom portion comprising the deformable wiping lip 31.

On an outer wall, the second part 3 comprises a second clamping boss 33 formed in line with the second skirt 32. More specifically here, the second clamping boss 33 is positioned in line with the second bearing surface 36, and therefore the locking means.

Furthermore, the second part 3 comprises a third clamping boss 34 on the outer wall situated on the second skirt 32. In particular, here, the third clamping boss 34 is situated, on the longitudinal axis XX, under the second clamping boss 33.

In line with the deformable wiping lip 31, the second part 3 comprises means 35, 351 for maintaining a geometry of the wiping lip 31. Here, the means 35, 351 for maintaining a geometry are formed on the outer wall of the second part 3 and in line with the wiping lip 31. The means for maintaining a geometry comprise a second annular groove 351 and an annular flange 35 forming a seal. Here, the second annular groove 351 has a "V" shaped section.

Now, referring to FIGS. 1*a* to 1*c*, there follows a brief description of an assembly of the first part 2 and of the second part 3 of the wiping device 1 according to the invention. Initially the first 2 and second 3 parts are brought one on top of the other so that their respective longitudinal axes XX coincide, the first skirt 21 being opposite the second skirt 32. Then, the first 2 and second 3 parts are moved toward one another in the snap-fitting direction parallel to the longitudinal axis XX, the first skirt 21 entering into the second skirt 32, the outer wall of the first skirt 21 being opposite and in sliding contact with the inner wall of the second skirt 32. The snap-fitting movement of the first part 2 in the second part 3 is continued until the second bearing surface 36 comes to be housed in the first annular groove 24 by coming opposite the first bearing surface 23. For that, the first tapered surface 22 deforms, in its passage, the top end of the second skirt 32. Then, the bottom end of the first skirt 21 comes to bear on the end-of-travel abutment 38. The snap-fitting is then produced. Dismantling is prevented, that is to say a separating movement reversing the direction of snap-fitting of the first part 2 in the second part 3: the first bearing surface 23 corning to bear by its surface with the second bearing surface 36, then locking the snap-fitting of the first skirt 21 in the second skirt 32.

Such an assembly of the wiping device 1 according to the invention is simplified by the fact that the first part 2 has a hardness greater than or equal to the second part 3.

Once thus assembled, the wiping device 1 according to the invention can be handled, transported, bulk-packaged without the risk of disassembly of the first 2 and second 3 parts, whether in a crate, or on an automatic or semiautomatic assembly line.

Figure 2:
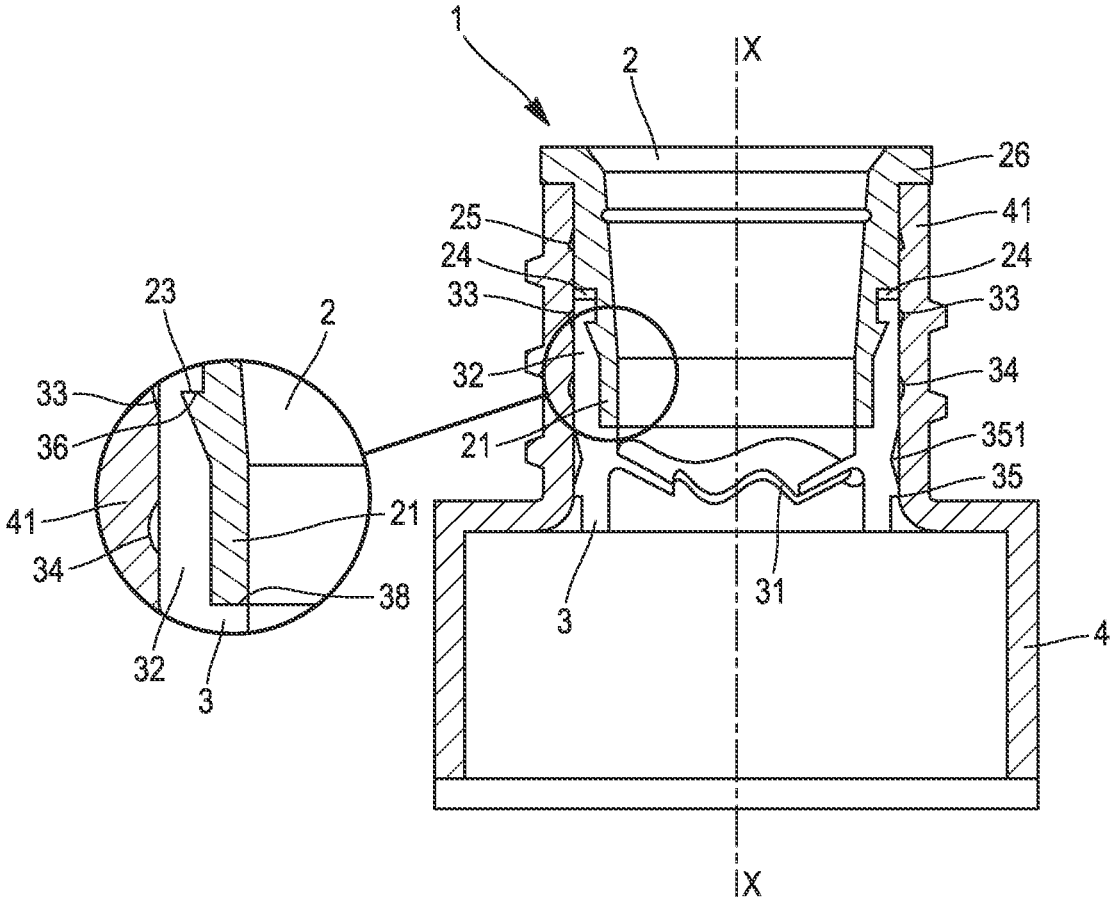
FIG. 2 are partial cross-sectional and detailed views illustrating the wiping device of FIG. 1 assembled and put in place in a reservoir neck.

Referring to FIG. 2, the wiping device 1 according to the invention as has just been described is put in place in a neck 41 of a reservoir 4 of a device for packaging and applying a fluid or pasty product. In this placement, the means 35, 351 for maintaining a geometry of the wiping lip 31 are deformed without the geometry of the wiping lip changing. Once in place, the first 25, second 33 and third 34 clamping bosses bear with deformation on an inner wall of the neck 41 ensuring a full tight hold of the wiping device 1 according to the invention in the neck 41 of the reservoir 4. The annular flange 35, forming a seal, ensures the seal-tightness between at least the second annular groove 351 and the product contained in the reservoir 4.

Obviously, numerous modifications can be made to the invention without n any way departing from the scope thereof.

The invention claimed is:

1. A wiping device for a device for packaging and applying a fluid or pasty product, the wiping device comprising first and second independent parts, the first part having a hardness greater than or equal to a hardness of the second part, the first part comprising a male portion formed by a first skirt, the second part comprising a deformable wiping lip and a female portion formed by a second skirt and arranged so as to receive, by snap-fitting, the first skirt of the first part, wherein the wiping device further comprises locking means for locking the snap-fitting of the first skirt in the second skirt wherein the second part comprises a first clamping boss and a second claiming boss, each formed on an outer wall of the second skirt, wherein the second clamping boss is positioned in line with the locking means.

2. The wiping device according to claim 1, wherein the locking means comprise a first bearing surface at a right angle to a snap-fitting direction formed on the first skirt and a second bearing surface at right angles to a snap-fitting direction formed on the second skirt, the first and second surfaces coming to bear against one another upon a relative movement of the two parts in a direction opposite to the snap-fitting direction.

3. The wiping device according to claim 2, wherein the locking means comprise a first tapered surface formed on the first skirt adjacent to and downstream of the first bearing surface in the snap-fitting direction.

4. The wiping device according to claim 2, wherein the locking means comprise a tapered surface formed on the second skirt adjacent to and downstream of the second bearing surface in the snap-fitting direction.

5. The wiping device according to claim 1, wherein the locking means are arranged on an outer wall of the first skirt and an inner wall of the second skirt.

6. The wiping device according to claim 1, wherein the second part comprises an end-of-travel abutment for the first part.

7. The wiping device according to claim 1, wherein the first part comprises a third clamping boss formed on an outer wall of the first part.

8. The wiping device according to claim 1, wherein the second part comprises means for maintaining a geometry of the deformable wiping lip.

9. The wiping device according to claim 8, wherein the means for maintaining a geometry comprises an annular groove formed on an outer wall of the second part in line with the deformable wiping lip.

* * * * *